US007185775B1

(12) United States Patent
Decal

(10) Patent No.: US 7,185,775 B1
(45) Date of Patent: Mar. 6, 2007

(54) BEVERAGE BOTTLE NIPPLE AND ADAPTER

(76) Inventor: Diego L. Decal, 33068 Boulevard of Champions, North Lauderdale, FL (US) 33068

( * ) Notice: Subject to any disclaimer, the term of this patent is extended or adjusted under 35 U.S.C. 154(b) by 65 days.

(21) Appl. No.: 10/886,296

(22) Filed: Jul. 8, 2004

(51) Int. Cl.
*A61J 11/04* (2006.01)
*A61J 11/00* (2006.01)

(52) U.S. Cl. ..... 215/11.1

(58) Field of Classification Search ..... 215/11.1, 215/356, 386, 319, 320; 220/714
See application file for complete search history.

(56) References Cited

U.S. PATENT DOCUMENTS

| | | | | | |
|---|---|---|---|---|---|
| 177,185 | A | * | 5/1876 | Whitney | 215/11.1 |
| 1,623,544 | A | * | 4/1927 | Kushner | 215/11.6 |
| 2,446,451 | A | * | 8/1948 | Allen | 215/11.1 |
| 2,497,198 | A | * | 2/1950 | Allen | 215/11.1 |
| 2,771,073 | A | * | 11/1956 | Wharton | 215/11.1 |
| 2,800,241 | A | * | 7/1957 | Brune et al. | 215/309 |
| 2,816,548 | A | * | 12/1957 | Tupper | 215/11.1 |
| 2,830,722 | A | * | 4/1958 | Darmstadt | 215/12.1 |
| 2,876,113 | A | * | 3/1959 | Barton | 426/117 |
| 3,232,467 | A | * | 2/1966 | Barton | 215/11.3 |
| 3,253,753 | A | * | 5/1966 | Barton et al. | 222/547 |
| 3,422,998 | A | * | 1/1969 | Murray | 222/567 |
| 3,434,636 | A | * | 3/1969 | Kachman | 222/567 |
| 3,595,421 | A | * | 7/1971 | Sanchis | 215/309 |
| 3,757,784 | A | * | 9/1973 | Avery | 604/76 |
| 3,926,348 | A | * | 12/1975 | Lutzker | 222/189.07 |
| 4,583,652 | A | * | 4/1986 | Goldberg | 215/256 |
| 4,630,742 | A | * | 12/1986 | Miyaji et al. | 215/12.1 |
| 4,711,365 | A | * | 12/1987 | Fomby | 220/288 |
| 4,867,324 | A | * | 9/1989 | Rogosich et al. | 215/11.1 |
| 4,994,076 | A | * | 2/1991 | Guss | 606/236 |
| 5,156,284 | A | * | 10/1992 | del Pilar Pla Rodriguez et al. | 215/11.6 |
| 5,419,445 | A | * | 5/1995 | Kaesemeyer | 215/11.1 |
| 5,749,483 | A | * | 5/1998 | Tebeau | 215/11.4 |
| 5,749,491 | A | * | 5/1998 | Wylder et al. | 220/719 |
| 5,758,787 | A | * | 6/1998 | Sheu | 215/11.1 |
| 5,857,580 | A | * | 1/1999 | Iidaka | 215/256 |
| 5,897,007 | A | * | 4/1999 | Schein et al. | 215/11.1 |
| D414,873 | S | * | 10/1999 | Kwiecinski | D24/197 |
| 6,354,449 | B1 | | 3/2002 | Smith | |
| D459,815 | S | | 7/2002 | Pastucha | |
| 6,415,937 | B1 | * | 7/2002 | DeJong et al. | 215/386 |
| 6,666,345 | B2 | | 12/2003 | Blanding | |
| 2002/0046983 | A1 | * | 4/2002 | Shin et al. | 215/276 |
| 2003/0029829 | A1 | * | 2/2003 | Stephan | 215/387 |
| 2005/0072749 | A1 | * | 4/2005 | Primavera et al. | 215/11.1 |

FOREIGN PATENT DOCUMENTS

| | | | |
|---|---|---|---|
| GB | 2409201 A | * | 6/2005 |
| JP | 2001301785 | * | 10/2001 |

* cited by examiner

*Primary Examiner*—Sue A. Weaver
(74) *Attorney, Agent, or Firm*—Alvin S. Blum

(57) ABSTRACT

A nursing nipple is sealingly attached to a beverage container having a neck with a particular internal diameter by the invention. Sealingly attached below the nipple is an axial passage in fluid communication with the nipple. Many thin, resilient annular rings surround the passage. They have an external diameter larger than the internal diameter of the container neck. When the rings are forced into the neck of the container, they are compressed against the inner surface of the neck. This secures and seals the nipple to the container providing a convenient source of fluid for a baby.

4 Claims, 3 Drawing Sheets

BEVERAGE BOTTLE NIPPLE AND ADAPTER

This invention relates to baby bottle nipples, and more specifically to an adapter for securing a nipple to a beverage container that is not provided with the threads of a standard baby bottle.

BACKGROUND OF THE INVENTION

Feeding bottles for babies have a standard external thread. This is adapted to receive either a threaded cover for transport and storage in the sterile condition, or to receive a threaded ring for clamping a flange of a rubber nipple against the neck of the bottle. There are many sources of fluid in sterile bottles that would be convenient for baby feeding on occasion. Unfortunately, they are made for adult consumption with small external threads incompatible with the standard nipple clamp ring. U.S. Pat. No. 6,354,449 issued Mar. 12, 2002 to Smith discusses the prior art inventions for using these bottles with a nipple. They all involve employing the external threads of the bottle. Since the various beverage bottles may have different threads, and some may have no threads, it would be advantageous to have an adapter that did not rely on the screw threads of the container.

SUMMARY OF THE INVENTION

It is accordingly an object of the invention to provide an adapter for securing a nipple to a beverage container that does not use the external threads. It is another object that the adapter use conventional nipples and clamp rings. It is another object that the adapter fit a number of different beverage containers.

The adapter of the invention has an internal axial passage through which the fluid will pass. A plurality of annular, thin, resilient flanges surround the lower portion of passage, and extend orthogonally to the passage. Their diameter is greater than the inside diameter of the neck of the container. When the lower portion of the adapter is forced into the neck of a container, the flanges deform, gripping and sealing to the interior surface of the neck. Above the flanges is a larger diameter annular portion with external threads adapted to cooperate with the internal threads of a standard nipple clamp ring. The top of the adapter has a smooth flat annular portion to seal against the flange of the nipple, by tightening the nipple clamp ring to thereby form a liquid tight seal of the adapter to the nipple.

In another embodiment of the invention, the adapter engages an inner aspect of the nipple.

Optionally, in another embodiment of the invention, the nipple is fixedly attached to the adapter.

These, and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
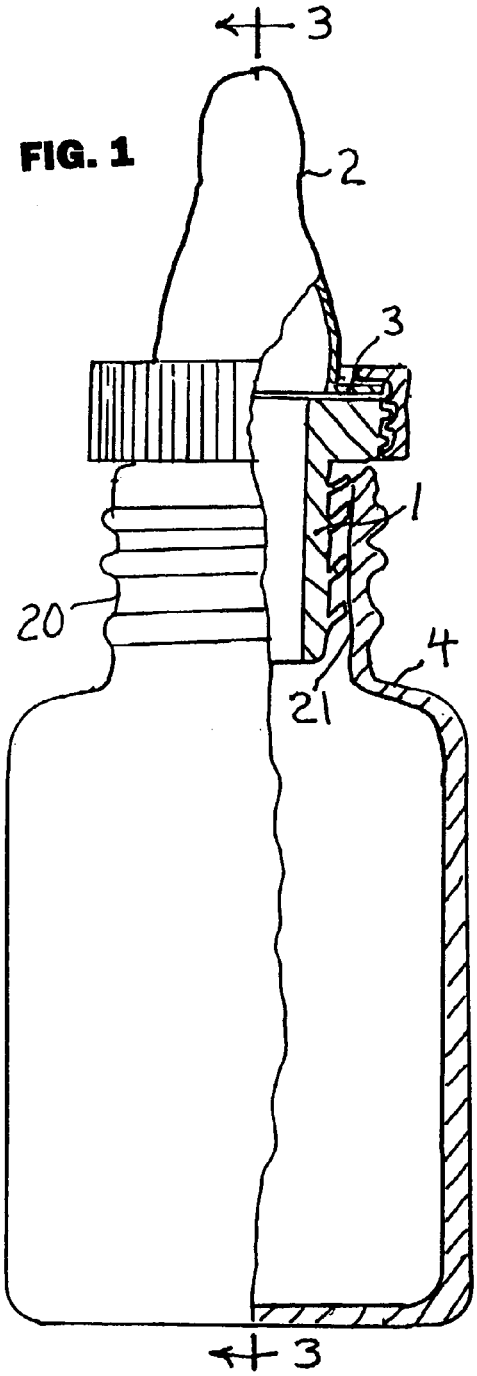
FIG. 1 is a front elevation view, with a portion broken away, of the adapter in use.
Figure 3:
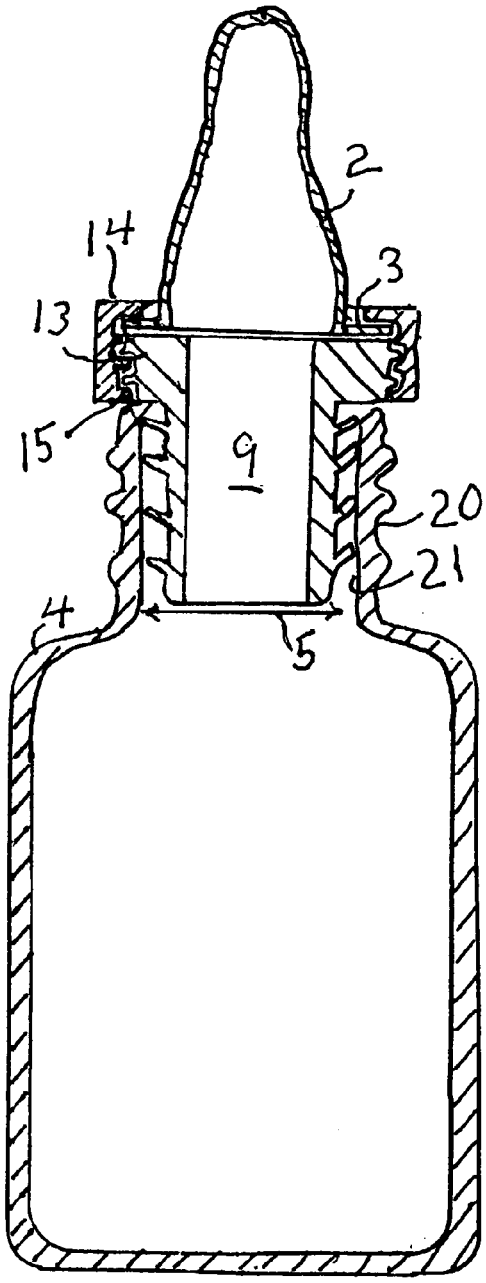
FIG. 3 is a sectional view through line 3—3 of FIG. 1.
Figure 2:
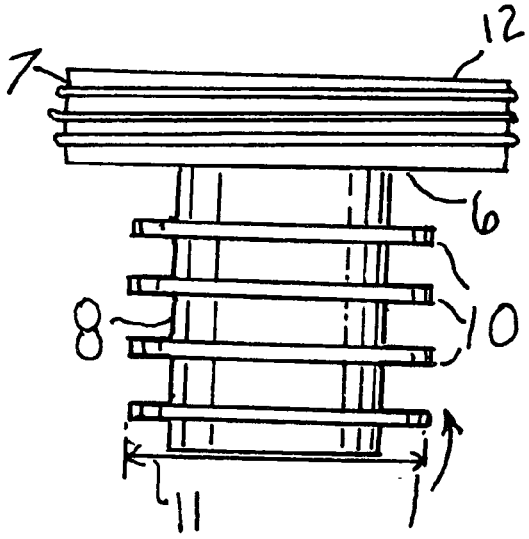
FIG. 2 is a front elevation view of the adapter of the invention.

Referring now to the drawing FIGS. 1–3, an adapter 1 of the invention is provided for sealing a nipple 2 to a beverage container 4, such as a screw cap sealed bottle of water. The neck of the container has an inside diameter 5. The adapter has a body 6, a top portion 7, a bottom portion 8, and an axial through passage 9 for fluid. A plurality of thin, resilient annular flanges 10 affixed to the bottom portion 8 surround the passage 9. They have an outside diameter 11 that is greater than the inside diameter 5 of the container neck 20. When the bottom portion 8 is forced into the neck, the flanges 10 are compressed against the inside surface 21 of neck, securing the adapter in the container, and sealing the junction therebetween. A smooth flat annular surface 12 is at the upper end of top portion 7 of the body. It is dimensioned to mate sealingly against the bottom flange 3 of the nipple. A threaded annular section of the top portion 7 below the annular surface 12 has external threads 13 matching the internal threads 15 of a nipple clamp ring 14. When the clamp ring is threaded on the adapter, the nipple flange is pressed against the flat annular surface 12 for a tight seal.

Figure 4:
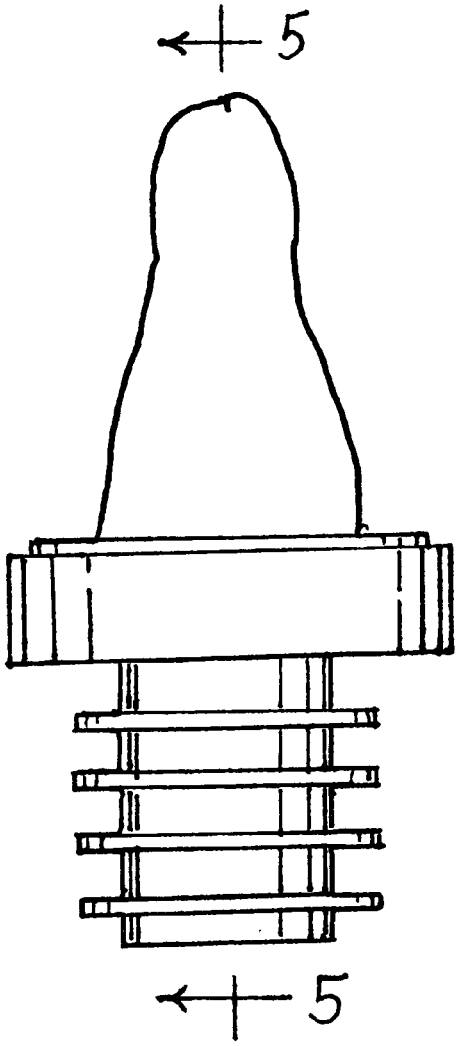
FIG. 4 is a front elevation view of another embodiment of the invention.
Figure 5:
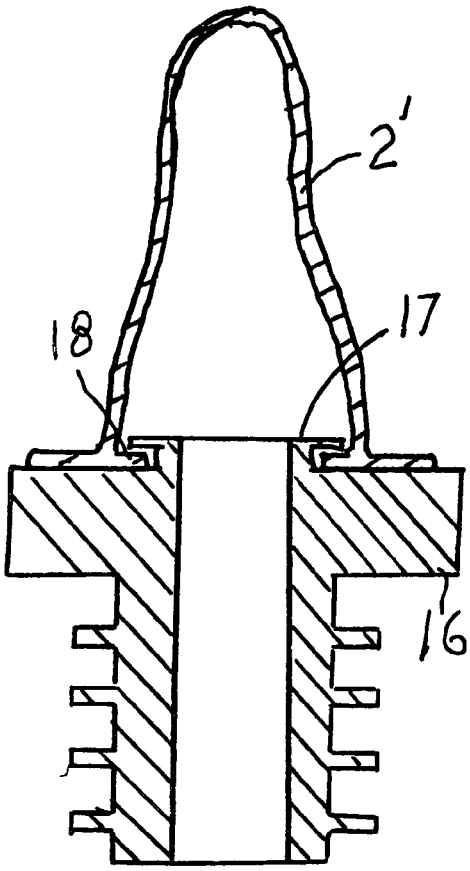
FIG. 5 is a sectional view through line 5—5 of FIG. 4.

Referring now to FIGS. 4 and 5, another embodiment 16 of the invention is shown for use with a nipple 2' of the type having an inner element 18 at the lower portion of the nipple. A top portion 17 of the adapter is dimensioned for sealing and securing to the inner element.

Figure 6:
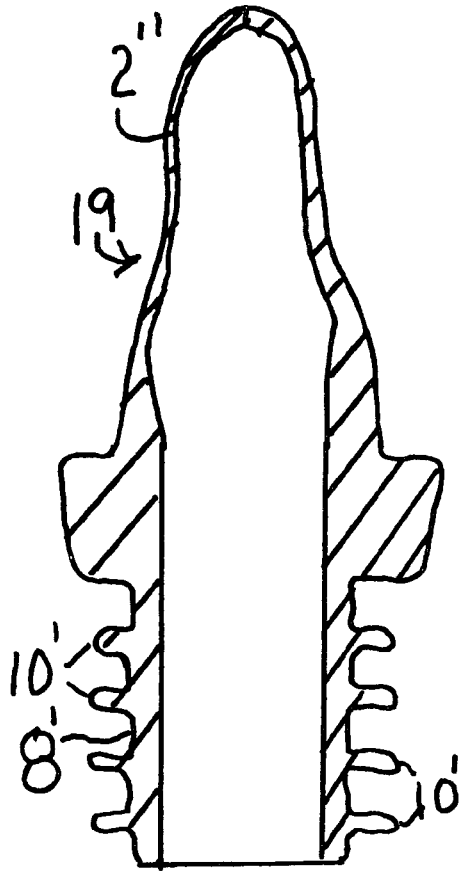
FIG. 6 is a sectional view as in FIG. 5 of another embodiment of the invention.

Referring now to FIG. 6 another embodiment 19 of the invention is shown in which the nipple 2" is formed in one piece with the lower portion 8' having the flanges 10'.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. An adapter for sealing a baby bottle nipple having a bottom flange to a beverage container having a neck with an inside diameter, the adapter comprising:

a) a body having a top portion, a bottom portion, and an axial through passage for fluid;

b) a plurality of thin, resilient annular flanges surrounding the passage of the bottom portion, the flanges extending orthogonally to the passage axis and having an outside diameter greater than the inside diameter of the neck of the beverage container to be used therewith;

c) a smooth flat annular top surface at the top of the top portion dimensioned to mate with the bottom flange of the nipple; and d) a threaded annular section of the top portion below the flat annular surface provided with threads matching threads of a nipple clamp ring for sealing the bottom flange of the nipple against the top surface.

2. An adapter for sealing a lower section of a baby bottle nipple to a beverage container having a neck with an inside diameter, the adapter comprising:

a) a body having a top portion, a bottom portion, and an axial through passage for fluid;

b) a plurality of thin, resilient annular flanges surrounding the passage of the bottom portion, the flanges extending orthogonally to the passage axis and having an outside diameter greater than the inside diameter of the neck of the beverage container to be used therewith; and c) the top portion dimensioned for sealingly attaching to the lower section of the nipple.

3. The adapter according to claim 2 in which the nipple is formed in one piece with the body.

4. A bottle nipple for sealing to a beverage container having a neck with an inside diameter, the nipple comprising:

a) a body having a top portion, a bottom portion, and an axial through passage for fluid;

b) a plurality of thin, resilient annular flanges surrounding the passage of the bottom portion, the flanges extending orthogonally to the passage axis and having an outside diameter greater than the inside diameter of the neck of the beverage container to be used therewith; and c) a nursing nipple portion sealingly attached to the top portion, the nursing nipple portion having an internal axial channel in fluid communication with the through passage.

* * * * *